US008117782B2

(12) United States Patent
Gross et al.

(10) Patent No.: US 8,117,782 B2
(45) Date of Patent: Feb. 21, 2012

(54) TACTICAL ILLUMINATOR

(75) Inventors: Barbara R. Gross, Collierville, TN (US); Danny Holmes, Collierville, TN (US); Tom Branski, Yarnell, AZ (US); Tuvia Faifer, Mishmar Hashiva (IL); Jeffrey N. DeGracia, Sanford, FL (US)

(73) Assignee: PowerTech, Inc., Collierville, TN (US)

( * ) Notice: Subject to any disclaimer, the term of this patent is extended or adjusted under 35 U.S.C. 154(b) by 168 days.

(21) Appl. No.: 12/381,386

(22) Filed: Mar. 11, 2009

(65) Prior Publication Data

US 2011/0167707 A1 Jul. 14, 2011

Related U.S. Application Data

(60) Provisional application No. 61/068,899, filed on Mar. 11, 2008.

(51) Int. Cl.
*F41G 1/35* (2006.01)

(52) U.S. Cl. ..... 42/146; 362/110; 42/114

(58) Field of Classification Search ..... 42/146, 42/71.01, 71.02, 72, 73, 74, 94, 114; 362/110, 362/111, 114, 259, 205, 206; 89/1.42; D22/108
See application file for complete search history.

(56) References Cited

U.S. PATENT DOCUMENTS 5,064,988 A * 11/1991 E'nama et al. ..... 219/121.6
5,654,594 A * 8/1997 Bjornsen et al. ..... 307/115
5,685,105 A * 11/1997 Teetzel ..... 42/146
5,704,155 A * 1/1998 Primeau, IV ..... 42/114
5,727,346 A * 3/1998 Lazzarini et al. ..... 42/146
5,758,448 A * 6/1998 Thummel ..... 42/114
5,913,669 A * 6/1999 Hansen et al. ..... 42/146
6,385,893 B1 * 5/2002 Cheng ..... 42/124
6,622,416 B2 * 9/2003 Kim ..... 42/146
6,785,997 B2 * 9/2004 Oz ..... 42/94
6,851,214 B2 * 2/2005 Oz ..... 42/146
6,935,066 B2 * 8/2005 Davenport et al. ..... 42/114
7,264,369 B1 * 9/2007 Howe ..... 362/114
D555,224 S * 11/2007 Florea et al. ..... D22/109
D585,516 S * 1/2009 Smith ..... D22/108
D585,517 S * 1/2009 Faifer et al. ..... D22/108
7,685,761 B2 * 3/2010 Wu ..... 42/146
7,736,013 B2 * 6/2010 Griffin ..... 362/110
2004/0055202 A1 * 3/2004 Oz ..... 42/146
2004/0060222 A1 * 4/2004 Oz ..... 42/146
2005/0243542 A1 * 11/2005 Kim ..... 362/110
2006/0026882 A1 * 2/2006 Miller et al. ..... 42/72
2006/0050502 A1 * 3/2006 Ross et al. ..... 362/110
2006/0196099 A1 * 9/2006 Matthews et al. ..... 42/146
2007/0039225 A1 * 2/2007 Kallio et al. ..... 42/146
2007/0039226 A1 * 2/2007 Stokes ..... 42/146
2007/0137087 A1 * 6/2007 Florea et al. ..... 42/90
2007/0227056 A1 * 10/2007 Howe et al. ..... 42/146
2007/0277422 A1 * 12/2007 Ding ..... 42/146
2008/0094823 A1 * 4/2008 Kim ..... 362/110
2008/0205037 A1 * 8/2008 Griffin ..... 362/110
2009/0044439 A1 * 2/2009 Phillips et al. ..... 42/72
2009/0084016 A1 * 4/2009 Wu ..... 42/90
2009/0122527 A1 * 5/2009 Galli ..... 362/110
2009/0140015 A1 * 6/2009 Faifer ..... 224/191
2009/0178325 A1 * 7/2009 Veilleux ..... 42/117

(Continued)

*Primary Examiner* — Benjamin P Lee
(74) *Attorney, Agent, or Firm* — Triangle Patents

(57) ABSTRACT

A tactical illuminator having an integrated illuminator system including a horizontally-oriented foregrip, a power source, a rotary switch, a toggle switch, a depressible switch, an attachment mechanism, navigation lights, an aiming laser, and a main illuminator.

10 Claims, 7 Drawing Sheets

U.S. PATENT DOCUMENTS

2009/0201674 A1* 8/2009 Ross et al. ..... 362/191
2010/0146835 A1* 6/2010 Mc Nulty, Jr. ..... 42/1.08
2010/0218410 A1* 9/2010 Cabahug et al. ..... 42/71.01
2010/0229448 A1* 9/2010 Houde-Walter et al. ..... 42/72
2010/0242332 A1* 9/2010 Teetzel et al. ..... 42/72

* cited by examiner

TACTICAL ILLUMINATOR

CROSS-REFERENCE TO RELATED APPLICATIONS

This application claims the benefit of one or more prior-filed, applications: it claims priority from U.S. Provisional Patent Application No. 61/068,899 filed Mar. 11, 2008.

BACKGROUND OF THE INVENTION

1. Field of the Invention

The present invention relates generally to illuminators. Further, the present invention relates to weapon-mounted illuminators.

2. Description of the Prior Art

Generally while using a weapon, such as a rifle, for tactical purposes, it is desirable to illuminate an area for visibility reasons. Additionally, it is desirable to have an aiming device on the rifle to assist with targeting. Tactical use implies providing a temporary advantage to the user of the weapon. And tactical by itself, in this context, generally refers to law enforcement, military, and other situations where the weapon is used against other persons when such use is warranted. Additionally civilian use in self-defense situations may be assisted by various illuminating and aiming devices attached to a weapon.

There are several different cases where one would need some sort of illumination during tactical use of a weapon. These are aiming, main illumination, and supplemental illumination.

Aiming is usually provided by an aiming device attached to the weapon that includes a laser. The laser can zero to the barrel to allow one to hit a target that is illuminated by the laser light.

Main illumination is usually provided by a main illuminator attached to the weapon that is a very bright light. This is desirable to illuminate a target for identification. Additionally it is bright enough to cause a certain reaction among most people such as a flinching, squinting, recoiling, and/or turning away from the bright light. These reactions occur most noticeably when a person's eyes have adjusted to the darkness and then the light is shined in their eyes. This can stun a person to the point where a tactical user of the weapon may not need to use deadly force.

Supplemental illumination is usually provided by a supplemental illuminator attached to the weapon that includes navigation lights. When a user is getting into a tactical situation, e.g. a law enforcement SWAT team about to raid a methamphetamine lab or an apartment complex, a bright light may give away the users position and may reflect off other objects and blind the user or their team members. However the user may need a small amount of light to provide a pathway or to identify that the user has found the proper door number. The light color of a supplemental illuminator is chosen to be a color that will not ruin the users night vision. Typically red is chosen as it won't undilate the users eyes.

Other purposes of supplemental lights include better illuminating an area for a user of night vision goggles and similar devices which amplify ambient and infrared light. In this case the supplemental light is a infrared light source bulb which produces light in the 750 nm wavelength to about 950 nm. Infrared naturally occurs in the visible spectrum, and thus military personnel usually have an infrared emitter to increase lighting with night vision.

While the above three uses of light are needed by tactical users of a weapon, the user must remove one illuminator for another, which is a tedious task. Thus there is currently a need for a unit which is compact, mountable to a gun, and integrates all three illumination mechanisms in one unit.

DETAILED DESCRIPTION

Figure 1:
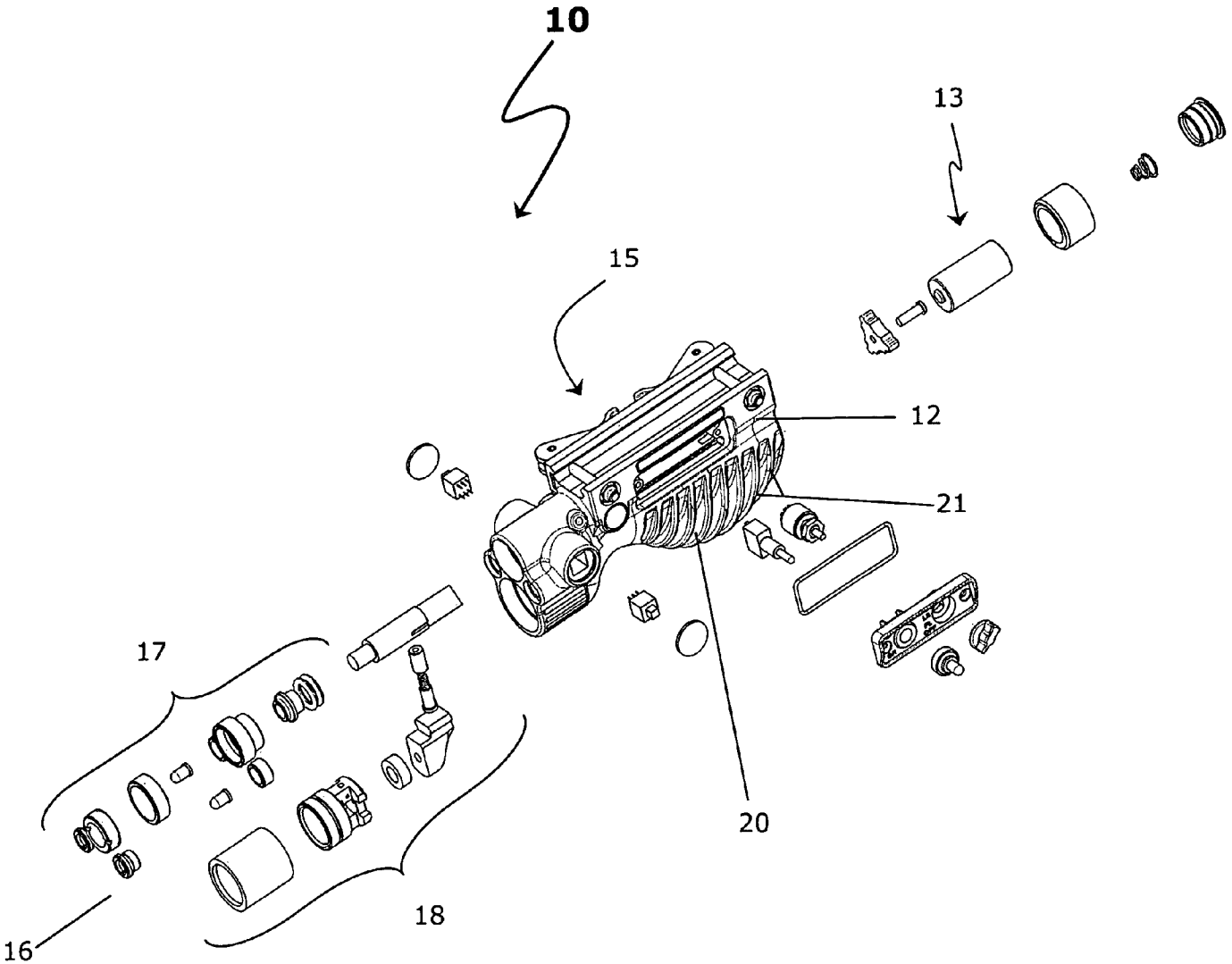
FIG. 1 is an exploded perspective view of the tactical illuminator illustrating one embodiment of the present invention.
Figure 2:
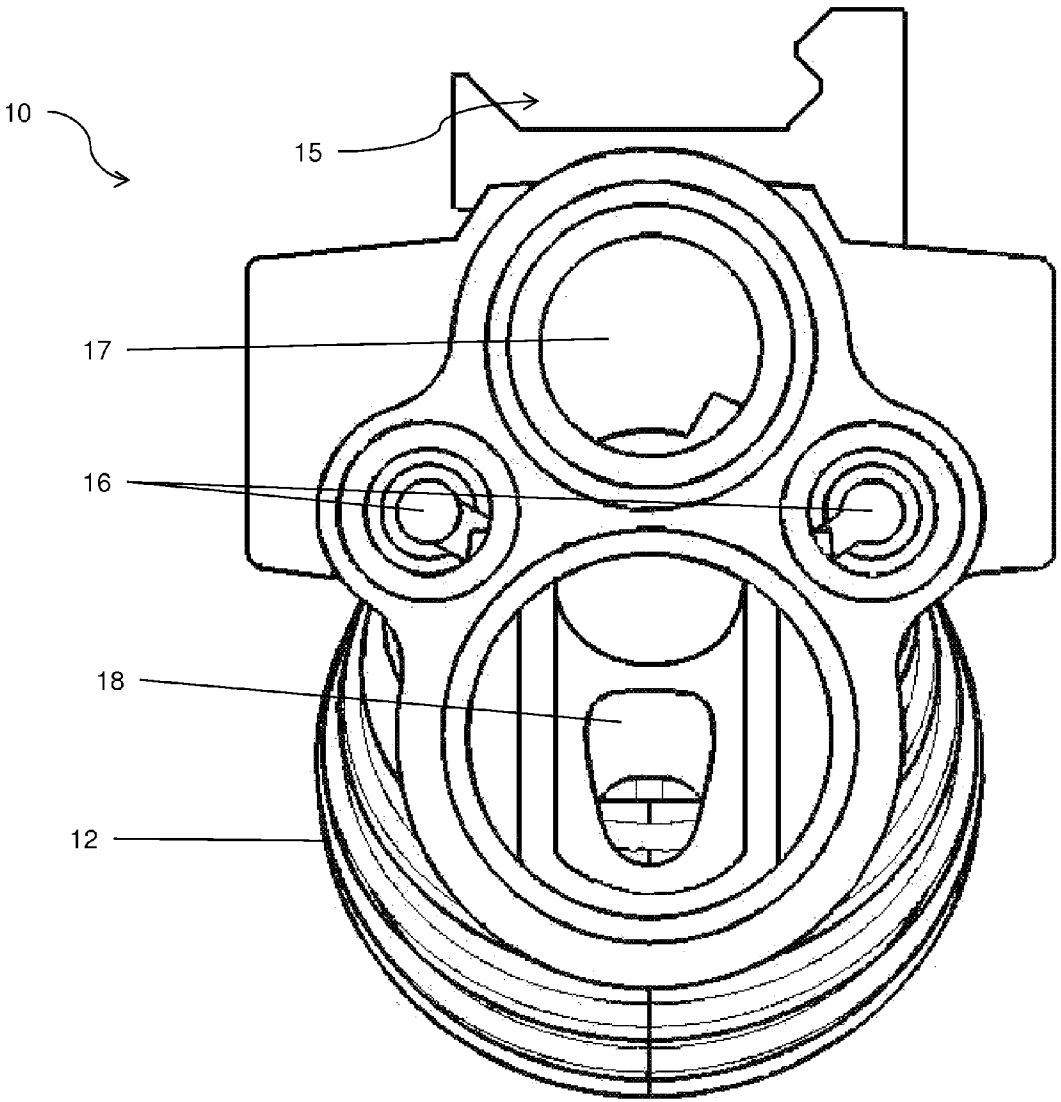
FIG. 2 is a front view of the tactical illuminator of FIG. 1 in an assembled view.
Figure 3:
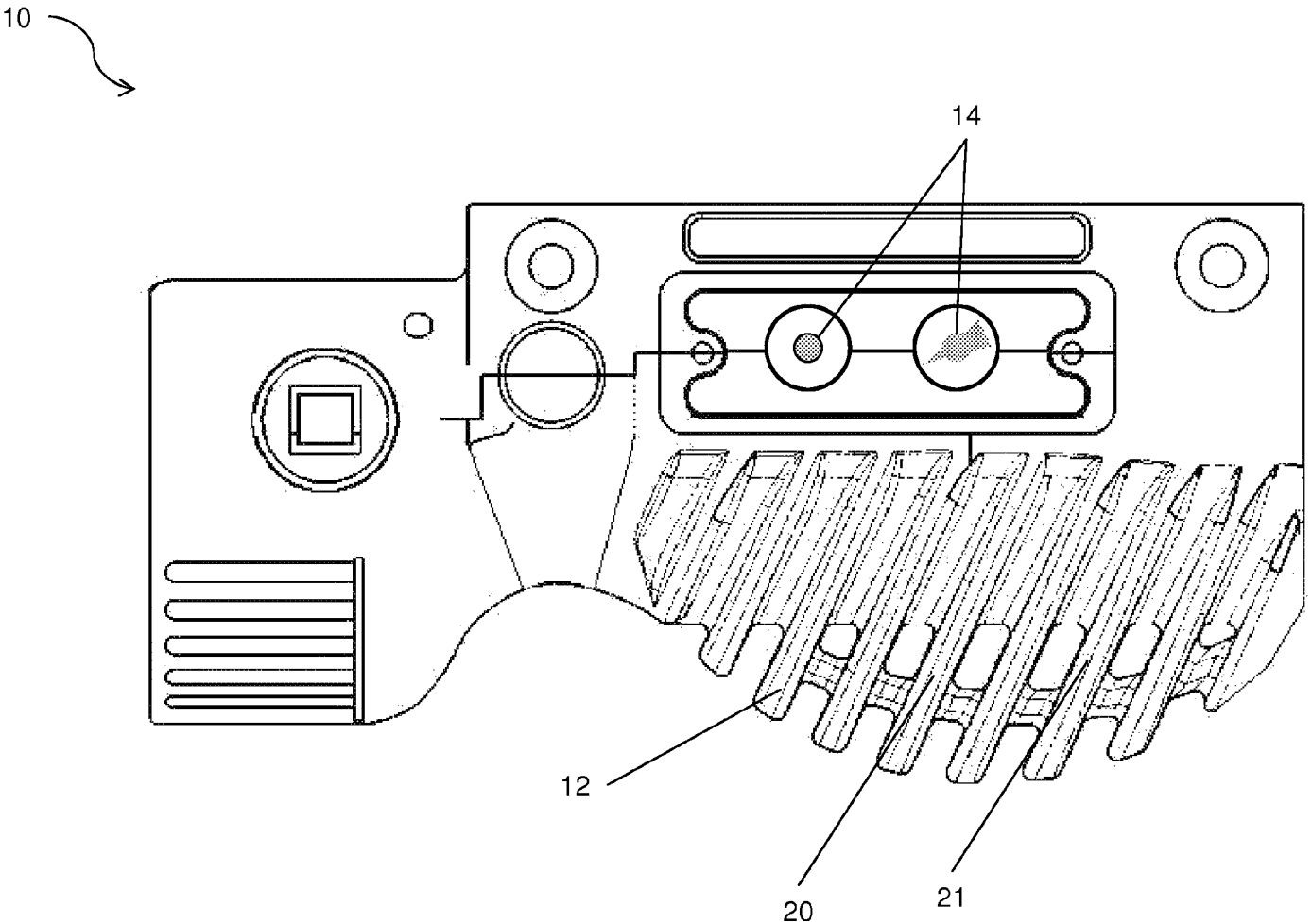
FIG. 3 is a side view of the tactical illuminator of FIG. 2.
Figure 4:
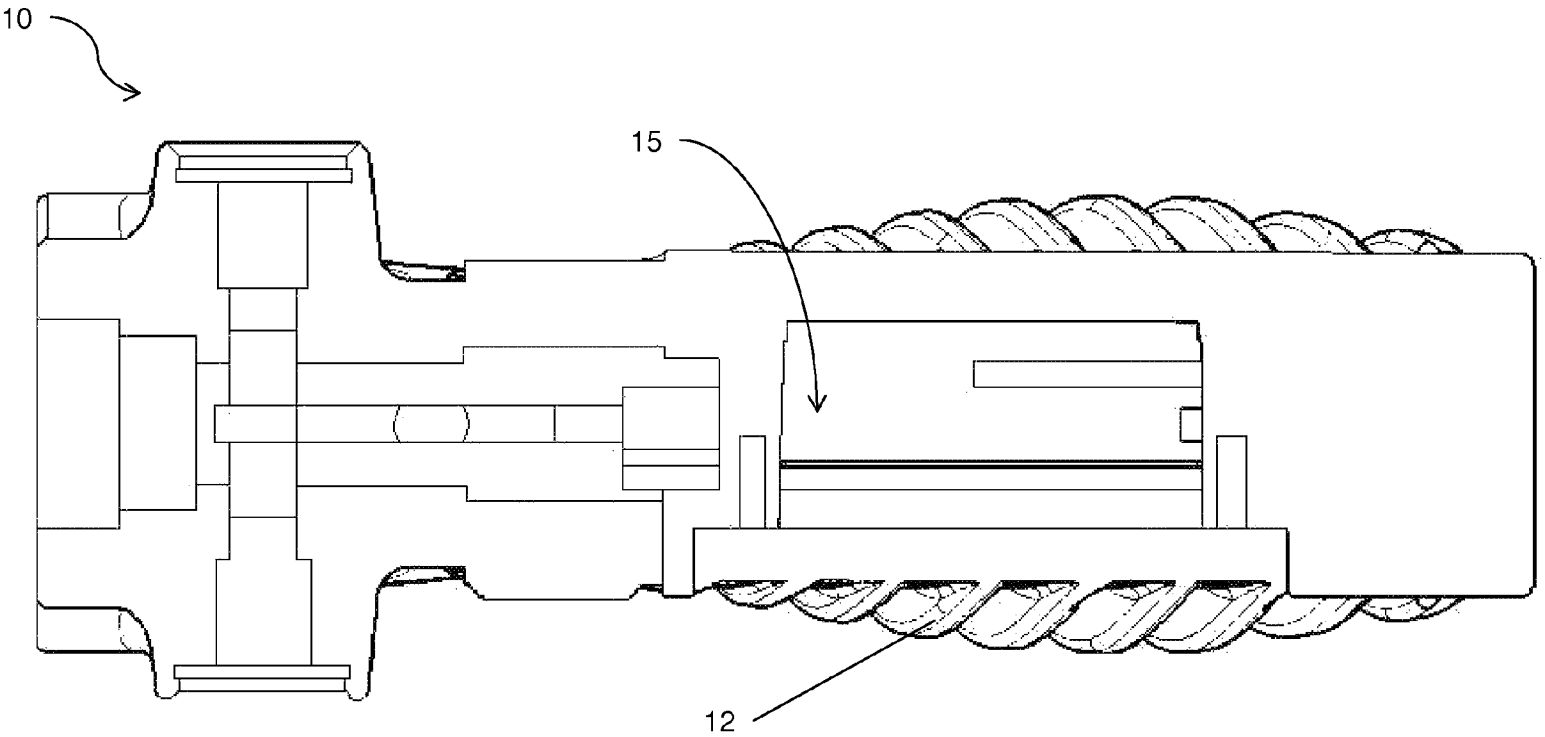
FIG. 4 is a top view of the tactical illuminator of FIG. 2
Figure 5:
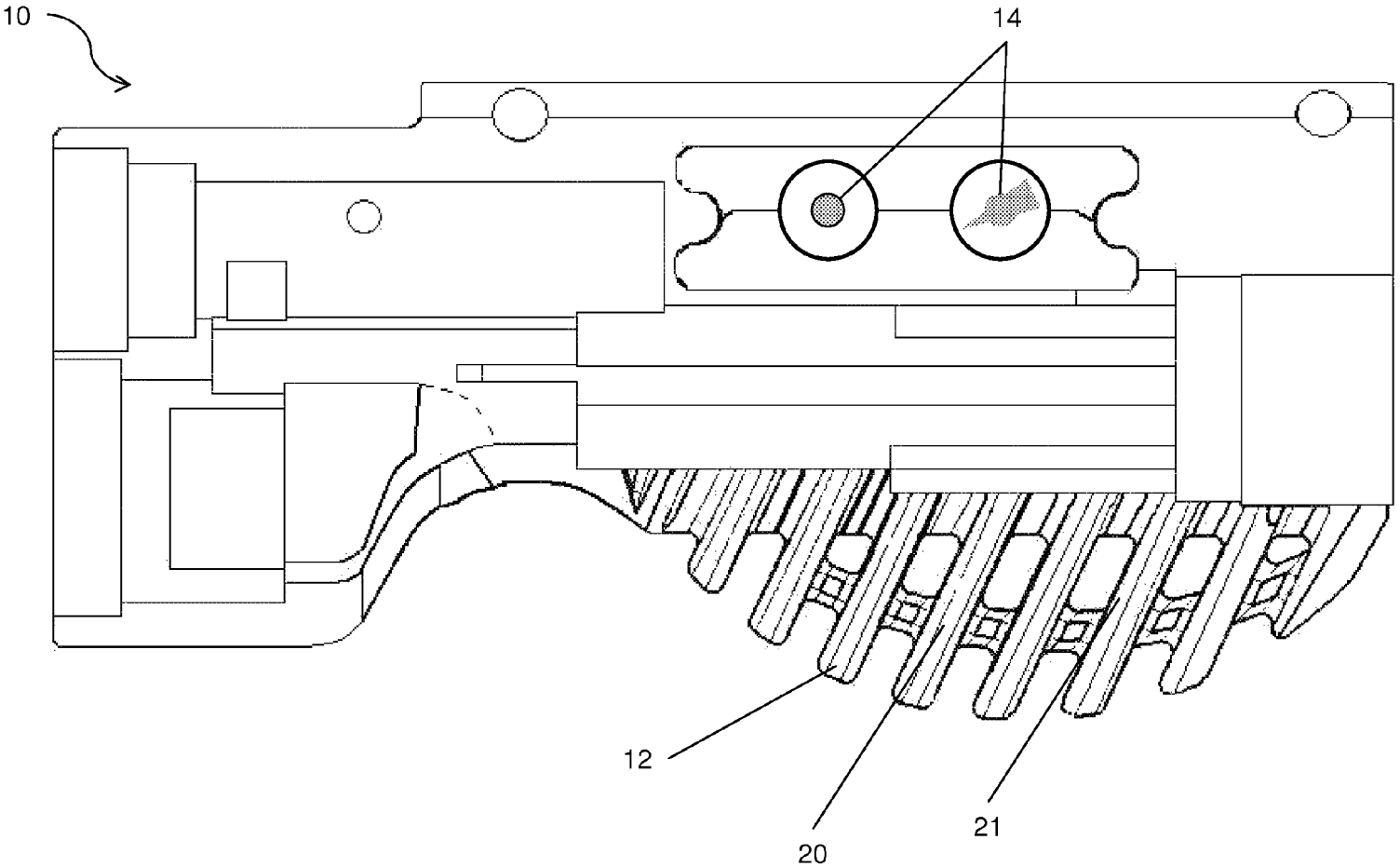
FIG. 5 is a side view of an alternative embodiment of the tactical illuminator of FIG. 3.
Figure 6:
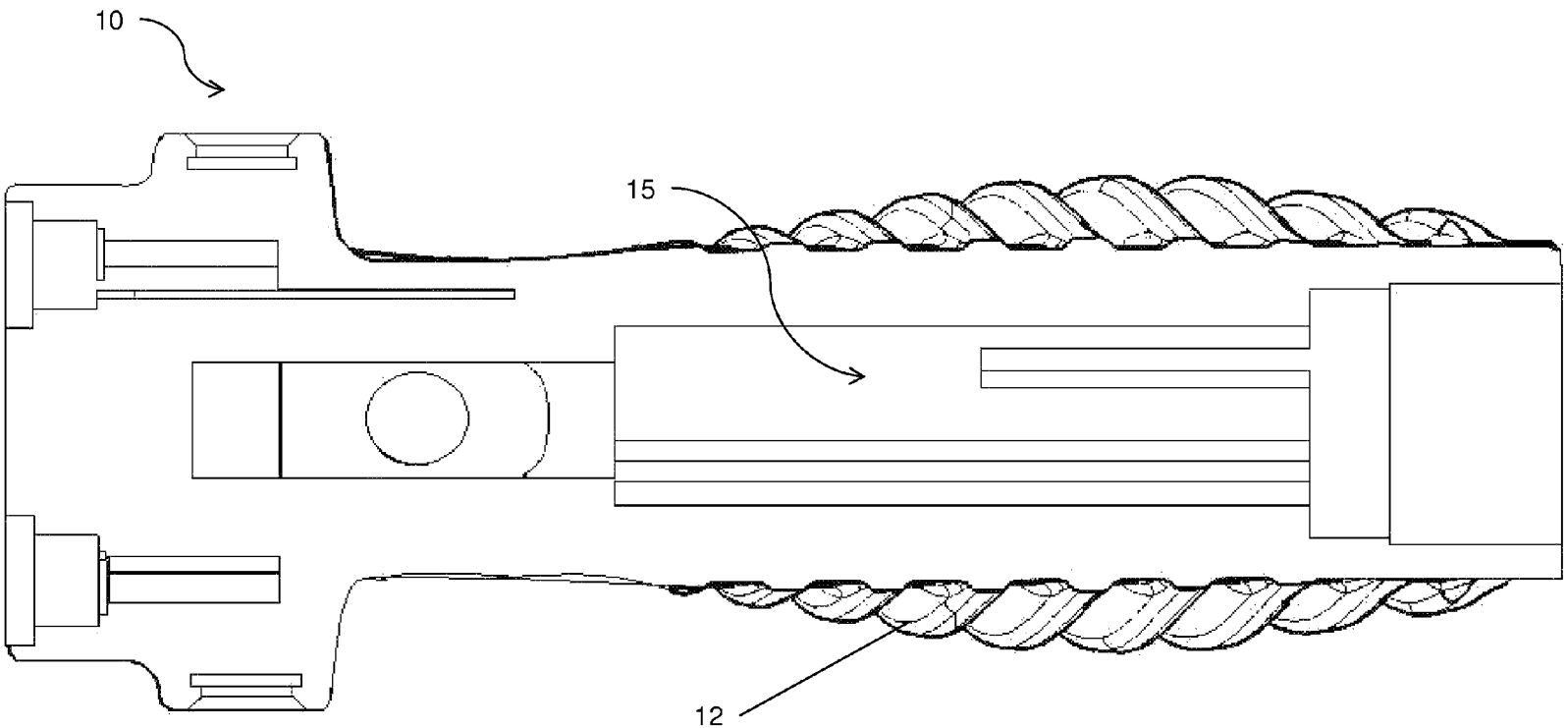
FIG. 6 is a top view of the tactical illuminator of FIG. 5.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

The present invention preferably provides a tactical illuminator having no vertical foregrip. A tactical illuminator of the present invention includes an integrated illuminator system including a horizontally-oriented body forming a foregrip, a power source, a rotary switch, a toggle switch, a depressible switch, an attachment mechanism, navigation lights, an aiming laser, and a main illuminator, wherein the horizontally-oriented body further includes an ergonimically shaped grip region constructed and configured to fit within the palm of a human hand. Advantageously, this body functions equally well for right- or left-handed users without requiring any adaptation or reorientation of the system with respect to weapon on which it is mountable.

Figure 7:
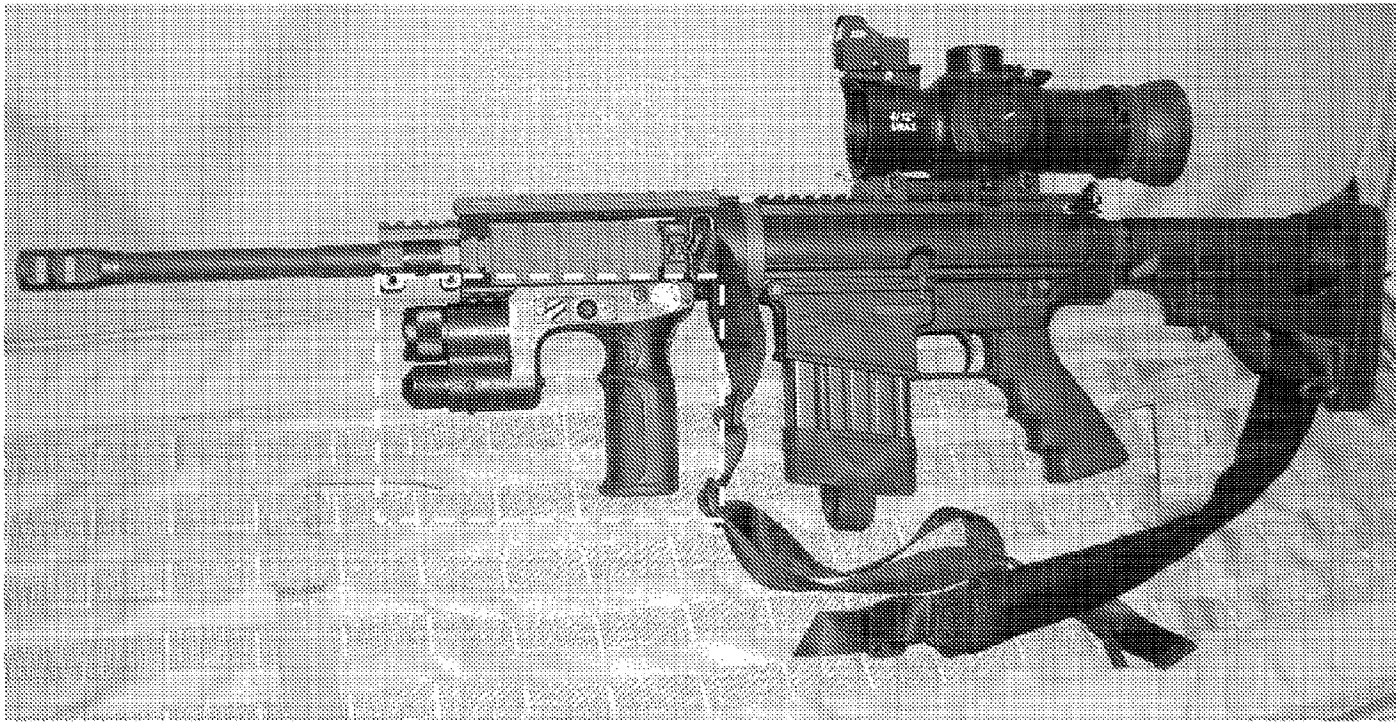
FIG. 7 is a photograph showing a side view of a tactical illuminator mounted on a gun and in use to illustrate the mounting area on a gun for the tactical illuminator according to the present invention.

Referring now to the drawings in general, the illustrations are for the purpose of describing a preferred embodiment of the invention and are not intended to limit the invention thereto. FIGS. 1-6 show various views of the tactical illuminator according to an embodiment of the present intention. FIG. 7 shows a view of a tactical illuminator mounted to a rifle and for use, to illustrate the mounting location and positioning of the tactical illuminator illustrated in the FIGS. 1-6 according to an embodiment of the present invention.

As illustrated in FIGS. 1-6, tactical illuminator of the present invention includes an integrated illuminator system, generally referenced 10, including a horizontally-oriented body forming a foregrip 12, a power source (battery) 13, switches 14, a single attachment mechanism 15, and lighting systems 16, 17, and 18; including navigation lights, an aiming laser, and a main illuminator, wherein the horizontally-oriented body further includes an ergonomically shaped grip region 20 constructed and configured to fit within the palm of a human hand. Advantageously, the integrated illuminator system includes all components in a compact region that are unitarily mountable to a weapon with a single mounting mechanism to ensure accurate alignment of the lighting systems with the weapon firing line. Also, advantageously, there are preferably a multiplicity of lighting systems, each having different functionality, that are integrated and aligned in the tactical illuminator of the present invention, including preferably navigation lights, an aiming laser, and a main illuminator. Furthermore, the controls for each of these lighting systems are also integrated with the horizontally-oriented body of the present invention and connectable or attachable to a weapon via a single connector mechanism. These controls are all strategically positioned proximal to the ergonomic and horizontally-oriented grip to allow maximum control of the device and weapon, while selectively activating the controls with the fingers. The grip is comfortable, while allowing control over the hand unit. In preferred embodiments, the grip further includes a textured surface; a spaced-apart ribbing pattern (21 of FIG. 1) is illustrated in the figures. Also, preferably, the shape of the body grip is not symmetrical. The cross-section of the grip region may be oval or substantially concentric circles having different but gradually increasing or decreasing diameter, wherein the largest diameter is positioned where the center region of the palm of a user's hand would most advantageously be placed for holding the device.

Also, in the present invention, while the installed illuminator system is unitary and integrally connected, having only one connector to be mounted to the weapon, the grip body may be removable to allow for replacement of the grip or to change sizes of the grip (such as small, medium, large or for male- or female-sized grip).

As best seen in FIG. 7, a tactical illuminator is attached to a rifle and is activated; the box on the diagram demarcates the general area where the tactical illuminator is mountable and preferably positioned in that region on the weapon. Notably, FIG. 7 shows a conventional vertically-oriented handle, whereas the preferred embodiments of the present invention provide for horizontally-oriented hand grip or foregrip that has a longitudinal body with a thickness and shape that is constructed, shaped and configured to fit within the palm of a human hand. The white dashed box demarcates generally where the tactical illuminator according to the present invention is located.

The illuminator unit is preferably waterproof and contains a 200+ lumen CREE LED main illuminator, a 10 mW green CQB laser/target designator, and dual LED navigation lights. Alternatively, the main illuminator is a 225+ lumen CREE Q-Bin LED, or any functional substitute that provides a bright light source. Generally, the main illuminator is a bright light source. According to this embodiment, the main illuminator is situated at the top of the illuminator, closest to the gun bore, the navigation lights are juxtaposed about the vertical centerline of the tactical illuminator and below the main illuminator, and the laser is located beneath the navigation lights. Alternatively, the position of the main illuminator and the laser may be reversed such that the laser is nearest the gun bore. This may be preferable because then the device would require less compensation for the difference in position between the targeting laser and the bore; less compensation in the angle of the laser is required the closer it sits to the gun bore.

In a preferred embodiment of the present invention, the main body of the tactical illuminator is made from a polymer housing that provides durability as well as reduces the total weight of the unit. The body that also forms the horizontally-oriented foregrip provides a method of better controlling the weapon and is ergonomic, and is not dependent upon the user's hand preference, since either right or left hand functions equally well on the longitudinally (side-to-side) symmetrical configuration of the body that also forms the foregrip area. Preferably when attempting to a control a large weapon such as a rifle, using a foregrip may be a superior and ergonomic way to direct the weapon left, right, up, and down, rather than merely using a weapon's vertically oriented handle.

Preferably, the tactical illuminator of the present invention includes a switch, more preferably, a four position rotary switch to select different states. Generally, the more options for the user, including switch positions, the better. The rotary switch controls the main illuminator and the laser. The different states that can be controlled by the rotary switch are: main light on, laser on, both main light and laser on, and lockout. The lockout state prevents inadvertent activation of any mode being selected. The function of the lockout is to selectively prevent the accidental activation of any lighting element. Power to the laser and the main illuminator is ultimately controlled by a depressible switch that is integrated preferably into the illuminator body and/or foregrip where a user's hand rests; this is the area between the users index finger and thumb. The depressible button is preferably positioned at the back of the tactical illuminator, near the top of the device, directly below the white "S" logo surrounded by a white circle in the photograph. Alternatively, the depressible button may be located elsewhere on the tactical illuminator according to the present invention; however, it is preferably constructed, configured and arranged in an ergonomic position. In use, for one embodiment of the present invention, a first push activates the main power momentarily and will deactivate power upon release; the state of the laser and main illuminator is determined by the rotary switch at this point, but whatever the state, the laser and/or main illuminator will deactivate upon releasing the depressible button. Pressing the depressible button fully to the end of travel, toggles a positive switch thereby activating a "constant-on" mode, that may produce an audible click. At this point, the main power is continuously on and the state of the laser and main illuminator is determined by the rotary switch. To deactivate the laser and/or illuminator, the user would press the depressible button again completely through its travel to disengage the "constant-on" mode.

The navigation lights are activated by a toggle switch positioned immediately behind the main illuminator and accessible to a finger of a user's hand that is holding the foregrip. Either the users forefinger or thumb will be used to activate the toggle switch, but importantly, it is not dependent on the user's hand preference since there is no vertical foregrip. The control for the navigation lights are separated from the control for the main illuminator and the laser to provide discretion to the end user as to when the navigation lights are activated. Also, the controls are separated such that the user would not accidentally turn on the main illuminator if the user is in a situation where darkness is desired. In that case, the navigation lights can be used to identify ones position and/or use the navigation lights as a signal. For example, the user could flash the navigation lights three times to notify another team member.

The tactical illuminator has an attachment mechanism for mounting the device on a weapon. In one embodiment, it attaches via a quick disconnect system that uses two cammed levers that act upon a bar that tightens the device against a rail, preferably a M1913 rail. A M1913 rail is a standard mounting interface that is on many military and commercial weapons. However, the present invention includes another mounting mechanism that holds the tactical illuminator to a weapon; it is preferable to have a single attachment point, whether that is a rail system or a single attachment connector. In one embodiment, a rail system is used for the single attachment point, but the connection is secured by two levers. The lighting unit, which includes the main illuminator, the navigation lights, and the laser, can be unscrewed or otherwise removed from the unit for servicing.

The navigation lights can be any number of colors, but are preferably red. According to one embodiment of the present invention, the navigation lights may be serviceable by an end user. Additionally the laser and the main illuminator are serviceable such that one could replace the laser with another targeting device, such as an infrared-laser for use with night vision devices, and one could replace the main illuminator light bulb with a different type.

The power source is provided preferably by lithium batteries, such as two CR123 3V lithium batteries. According to this embodiment of the present intention, this provides over two hours of run time; more run time is preferable. This power source is more compact and lighter in weight than other illuminator devices available. The batteries are preferably stored illuminator and wired to provide power to the lighting elements. Alternatively, the battery compartment may hold more than two batteries where they are wired in parallel to get a similar amount of voltage necessary but have an extra capacity for longer run time.

Certain modifications and improvements will occur to those skilled in the art upon a reading of the foregoing description. By way of example, according to the present invention, multiple laser aiming devices, such as visible and infrared lasers may be incorporated into the tactical illuminator. Also, multiple main illuminators, such as visible and infrared light sources, may be incorporated into the tactical illuminator according to the present invention. The above mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the following claims.

What is claimed is:

1. A tactical illuminator comprising an integrated illuminator system including a body forming a foregrip, a power source, at least one rotary switch, a first depressible button, a first positive toggle switch, a second toggle switch, an attachment mechanism for mounting the system to a weapon, at least one laser and at least one main illuminator light, and at least one navigation light; wherein the first positive toggle switch is at the end of travel of the first depressible button; wherein the second toggle switch activates the navigation light; wherein the at least one rotary switch is a four position rotary switch that selects between the states of light on, laser on, both light and laser on, and lockout; and wherein the lights and laser are selectively activatable by the first depressible button when the depressible switch is depressed and held and wherein the lights and laser are in constant-on mode when the first positive toggle switch is activated.

2. The illuminator of claim 1, with the body further including an ergonomically shaped grip region constructed and configured to fit within the palm of a human hand.

3. The illuminator of claim 2, wherein the body is asymmetrical.

4. The illuminator of claim 2, wherein the body includes a textured surface.

5. The illuminator of claim 2, wherein the body includes a spaced-apart ribbed surface.

6. The illuminator of claim 1, wherein the system is unitarily and integrally constructed and configured to be mountable to a weapon with one attachment mechanism.

7. The illuminator of claim 1, wherein the at least one light includes navigation lights, an aiming laser, and a main illuminator.

8. The illuminator of claim 1, wherein the foregrip is removable and replaceable.

9. The illuminator of claim 1, wherein the power supply is oriented in the same direction as the body.

10. The illuminator of claim 1, wherein the power supply is included within the body.

* * * * *